US008926180B2

(12) United States Patent
Bradford

(10) Patent No.: US 8,926,180 B2
(45) Date of Patent: Jan. 6, 2015

(54) DISC AND SPRING ISOLATION BEARING

(71) Applicant: R. J. Watson, Inc., Alden, NY (US)

(72) Inventor: Paul Fred Bradford, West Falls, NY (US)

(73) Assignee: R. J. Watson, Inc., Alden, NY (US)

( * ) Notice: Subject to any disclaimer, the term of this patent is extended or adjusted under 35 U.S.C. 154(b) by 0 days.

(21) Appl. No.: 13/919,321

(22) Filed: Jun. 17, 2013

(65) Prior Publication Data

US 2014/0270602 A1 Sep. 18, 2014

Related U.S. Application Data

(60) Provisional application No. 61/852,584, filed on Mar. 18, 2013.

(51) Int. Cl.

| | |
|---|---|
| ***F16C 41/00*** | (2006.01) |
| ***F16C 27/00*** | (2006.01) |
| ***E04B 1/98*** | (2006.01) |
| ***E04H 9/02*** | (2006.01) |
| ***F16F 7/00*** | (2006.01) |
| ***F16C 29/00*** | (2006.01) |

(52) U.S. Cl.

CPC ..... *E04H 9/021* (2013.01); *F16C 29/002* (2013.01)

USPC ..... 384/36; 384/37; 52/167.8; 267/141.1

(58) Field of Classification Search

USPC ..... 384/26, 36, 37; 52/167.1, 167.4, 52/167.7–167.9; 14/73.5; 267/141.1, 267/141.2; 188/372

See application file for complete search history.

(56) References Cited

U.S. PATENT DOCUMENTS

| | | | | |
|---|---|---|---|---|
| 3,429,622 | A * | 2/1969 | Lee et al. | 267/141.1 |
| 4,117,637 | A | 10/1978 | Robinson | |
| 4,187,573 | A | 2/1980 | Fyfe et al. | |
| 4,320,549 | A | 3/1982 | Greb | |

(Continued)

FOREIGN PATENT DOCUMENTS

| | | |
|---|---|---|
| JP | 2000257670 | 9/2000 |
| JP | 2012219570 | 11/2012 |

OTHER PUBLICATIONS

PCT Search Report and Written Opinion for PCT/US2014/027470, Jul. 24, 2014.

Notice of Allowance in U.S. Appl. No. 13/945,033, Jun. 16, 2014.

*Primary Examiner* — James Pilkington

(74) *Attorney, Agent, or Firm* — Jaeckle Fleischmann & Mugel, LLP

(57) ABSTRACT

The disclosed seismic isolation bearing includes an upper base plate, a lower base plate, a disc bearing core, and at least one shear spring. The upper and lower base plates each have an upper surface and a lower surface. The disc bearing core is centrally positioned with respect to the planes of the upper and lower base plates and is in contact with the lower surface of the upper base plate and the upper surface of the lower base plate, where the disc bearing core allows the lower surface of the upper base plate to slide along the disc bearing core. The shear spring is coupled to the lower surface of the upper base plate and the upper surface of the lower base plate, deforms in shear upon lateral movement of the upper base plate relative to the lower base plate, and exerts a lateral return force on the upper base plate when laterally displaced.

20 Claims, 10 Drawing Sheets

(56) References Cited

U.S. PATENT DOCUMENTS

| | | | |
|---|---|---|---|
| 4,499,694 | A | 2/1985 | Buckle et al. |
| 4,593,502 | A | 6/1986 | Buckle |
| 4,599,834 | A | 7/1986 | Fujimoto et al. |
| 4,644,714 | A | 2/1987 | Zayas |
| 5,303,524 | A | 4/1994 | Caspe |
| 5,461,835 | A | 10/1995 | Tarics |
| 5,491,937 | A | 2/1996 | Watson et al. |
| 5,867,951 | A | 2/1999 | Yaguchi et al. |
| 6,021,992 | A | 2/2000 | Yen et al. |
| 6,107,389 | A | 8/2000 | Oishi et al. |
| 6,126,136 | A | 10/2000 | Yen et al. |
| 6,160,864 | A | 12/2000 | Gou et al. |
| 8,011,142 | B2 | 9/2011 | Marioni |
| 2003/0167707 | A1 | 9/2003 | Tsai |
| 2004/0045236 | A1 | 3/2004 | Kim |
| 2006/0174555 | A1 | 8/2006 | Zayas et al. |
| 2008/0098671 | A1 | 5/2008 | Tsai |
| 2011/0016805 | A1 | 1/2011 | Tsai |

* cited by examiner

DISC AND SPRING ISOLATION BEARING

RELATED APPLICATION

This application claims the benefit of U.S. Provisional Application No. 61/852,584, filed on Mar. 18, 2013. The entire teachings of the above application are incorporated herein by reference.

BACKGROUND OF THE INVENTION

Isolation bearings are used to add damping or increase a response period of a structure, such as a bridge. The five core performance functions of an isolation bearing are to transfer a vertical load, allow for large lateral displacements, produce a damping force, produce a spring restoring force, and allow for structure rotation. Two fundamental types of isolation bearings are used to accomplish these performance functions: sliding bearings and steel reinforced elastomeric bearings (SREB). Sliding bearings provide damping to a structure through frictional energy dissipation, but must include additional means to provide a restoring spring force. Elastomeric bearings provide restoring forces, but must include additional means to provide damping to the structure. Sliding isolators can incorporate springs to provide a restoring force. The isolation bearing disclosed in U.S. Pat. No. 5,491,937, for example, incorporates elastomeric compression springs. Upon displacement, both sliding and spring compression occurs, providing the necessary damping and restoring force requirements.

One drawback to sliding bearings with external springs is the space and cost required to fit the springs. Typically, compression springs can only be compressed to about 60% of their free length. At least one compression spring is required on each side of the bearing, meaning that the plan dimension of an isolator would be at least $L=B+(2\ d/0.6)=B+3.33\ d$, where L is the bearing plan dimension, B the load bearing element dimension, and d is the isolator seismic displacement. For small seismic displacements, this is typically not a severe limitation, but for large seismic displacements, the springs become overly-large and the bearing becomes too costly. In regions of high seismicity it is not uncommon to have seismic displacements of twelve inches and higher, resulting in bearing plan dimensions of forty-eight inches and larger. One problematic characteristic of such a bearing is that the spring rate is usually inversely proportional to spring length and proportional to its cross sectional area. Thus, if a long spring is used to accommodate a large seismic displacement, its diameter has to be large or the spring will be too weak. Thus, large seismic displacements cause both of the bearing's plan dimension and height to grow.

U.S. Pat. No. 4,599,834 describes a system in which a steel-reinforced elastomeric bearing's (SREB) upper surface is permitted to slide relative to the super structure, i.e., in essence sliding on top of an SREB. The center core of the SREB houses a friction element that is preloaded with compression springs, such that when the SREB displaces, sliding friction occurs. The internal friction mechanism serves to boost damping, as SREBs are typically low-damping bearings. Due to size constraints the mechanical spring friction mechanism is limited in the amount of vertical load it can support, e.g., it is not uncommon for bridge bearing loads to exceed 1,000 tons. Hence, for structural bearing applications the majority of the vertical load in such a design must be supported by the SREB. Further, displacement in the design is constrained to the central annular region. Since large displacements require large clearances, the practical design range is limited to small vertical loads and small displacements (e.g., mechanical equipment applications or small pedestrian bridges).

U.S. Pat. No. 5,867,951 describes a design in which a sliding isolator is stacked on top of an elastomeric bearing isolator. This approach prevents the isolator from sticking in one place due to static friction, thus allowing the isolator to attenuate high frequency vibrations. Shortcomings of this approach include the cost of profiling the sliding surface and the increase in structure elevation due to lateral displacement of the isolator.

Elastomeric isolation bearings can use both internal and external means to provide damping to the structure. A common external approach incorporates a central lead plug, to form a lead rubber bearing, such as described in U.S. Pat. Nos. 4,117,637, 4,499,694, and 4,593,502. Lead rubber bearing isolators are a widely-used type of seismic isolator. Elastomeric bearings in conjunction with dampers and mild steel elements have also been used, as described in U.S. Pat. No. 6,160,864. The elastomer can also be compounded to increase its damping capabilities, as in the case of high damping rubber bearings, as described in U.S. Pat. No. 6,107,389, but the level of damping is usually limited to less than 20% damping. Though rubber compounds exist with very high levels of damping, they exhibit high levels of creep, rendering them unsatisfactory for the vertical load performance function. A structure situated on a bearing with high creep properties would sag, leading to structural problems.

Restoring force issues aside, sliding bearings can be designed to accommodate high displacements by making the sliding surface larger. For SREBs, the problem is more complex. There are design limits on how much an elastomeric bearing can shear; if it displaces too much the isolator can buckle. One way to prevent this is to make the bearing larger in plan. But as the bearing grows in plan dimensions, it becomes stiffer in shear, and the height must be increased as well. Thus, the entire bearing grows. Another problem is that the axial compressive pressure decreases with increasing plan dimension; thus, lead rubber bearings require high pressures to help maintain lead core confinement.

SUMMARY OF THE INVENTION

The embodiments of the present invention eliminate many of the key shortcomings of previous isolator designs as detailed above. This embodiments disclosed herein are isolation bearings that are capable of accommodating large seismic displacements. The isolation bearings reduce seismic forces and accelerations transferred from the ground to buildings, bridges, and other types of structures. The bearings accomplish this by softening the otherwise rigid connection between structural supports and the portion of the structure to be isolated. Often this connection occurs on top of the foundations for buildings and on top of bridge substructure elements, such as piers and abutments. Many of the embodiments use a central sliding high-load bearing element in conjunction with at least one shear spring element that is located, for example, at the bearing's periphery. The sliding surface provides damping while the shear spring provides a restoring force for the isolation bearing.

One example seismic isolation bearing includes an upper base plate, a lower base plate, a disc bearing core, and at least one shear spring. The upper and lower base plates each have an upper surface and a lower surface. The disc bearing core is centrally positioned with respect to the planes of the upper and lower base plates and is in contact with the lower surface of the upper base plate and the upper surface of the lower base plate, where the disc bearing core allows the lower surface of the upper base plate to slide along the disc bearing core. The shear spring is coupled to the lower surface of the upper base plate and the upper surface of the lower base plate and deforms in shear upon lateral movement of the upper base plate relative to the lower base plate. The shear spring exerts a lateral return force on the upper base plate when the upper base plate is laterally displaced.

In many embodiments, the shear spring includes alternating layers of an elastomeric material and a substrate material, where the shear spring is configured to deform in shear along the layers of elastomeric material. In such embodiments, the height of each layer of elastomeric material may be high compared to the plan area of the layer. For example, the shape factor of each layer of elastomeric material may be less than a value of 1. Further, the height of each layer of substrate material may be smaller than the height of each layer of elastomeric material to provide added damping. In many embodiments, the elastomeric material is rubber and the substrate material is steel. Alternatively, the layers of substrate material may be made of another elastomeric material that is stiffer than the layers of elastomeric material. The shear spring may include an upper mounting plate configured to attached to the lower surface of the upper base plate, and a lower mounting plate configured to attached to the upper surface of the lower base plate.

In embodiments where the upper base plate and the lower base plate are rectangular-shaped, there may be four shear springs positioned near the corners of the upper and lower base plates. In such embodiments, two of the four shear springs may be positioned along one edge of the upper and lower base plates, and the other two shear springs may be positioned along the opposite edge of the upper and lower base plates. In other embodiments, the shear spring may have an arc shape that partially surrounds the disc bearing core, or may have a circular shape that surrounds the disc bearing core.

In many embodiments, the disc bearing core includes an upper disc bearing plate, a lower disc bearing plate, and an elastomeric disc pad coupled between the upper disc bearing plate and the lower disc bearing plate. In such embodiments, the disc bearing core may be fixed to the upper surface of the lower base plate, or may slide along the upper surface of the lower base plate. The disc bearing core may also sit in a recess formed in the upper surface of the lower base plate. In embodiments having a recess, the recess may be concaved to cause the disc bearing core to maintain a centralized position in the absence of an external lateral force. The disc bearing core may or may not include a shear pin at its center to prevent shearing of the disc bearing core. In many embodiments, the disc bearing core is configured to support all of a load on the seismic isolation bearing, and the shear spring is configured to not support any of the load. Alternatively, the shear spring may configured to support up to one third of a total load on the seismic isolation bearing.

In further embodiments, the upper base plate includes edges that extend toward the lower base plate to provide a partial enclosure for the disc bearing core and the shear spring. In such embodiments, the shear spring may be coupled to the lower surface of the upper base plate via the edges extending toward the lower base plate.

Another example embodiment includes a centrally-located, high-load, multi-rotational, sliding bearing (HLMRB), with a rubber shear spring (RSS) located at the isolator's periphery. The sliding HLMRB may be a disc bearing, though it can be composed of other HLMRB types (e.g., pot or spherical). This solves the problem of having to use a small, high pressure, sliding surface. A disc bearing works well due to its reliability and vertical vibration energy absorption capabilities. Vertical load is predominantly supported by the central sliding bearing, but the shear spring(s) may take a lesser portion of the total vertical load. This provides design flexibility in specifying the level of friction damping; the more load the sliding bearing supports the higher the friction damping. In this embodiment, horizontal restoring force is provided by the shear spring(s). In one embodiment, the isolation bearing can be designed such that the sliding bearing supports nearly all of the vertical load. In this case the shear spring(s) is freed from many of the constraints placed upon elastomeric bearings. For example, a very high damping compound can be used because vertical load creep is no longer an issue. Further, the shear spring's geometry can be changed without concern to its load carrying capability, and for cases where the isolation bearing may experience uplift, the shear spring(s) can be configured to optimize its design for tensile capacity (a load condition with which previous isolator designs struggle). The disc bearing core and shear spring(s) are integrated into a compact isolation bearing design so as to reduce the footprint of the bearing, overcoming previous design limitations of excessive size. In addition, a box housing enclosure may provide environmental protection for the sliding surface, serving as a way to transfer both the sliding and restoring forces to the superstructure.

In summary, the embodiments disclosed herein eliminate many of the shortcomings experienced in current large displacement isolator designs through the use of an integrated sliding bearing core with at least one shear spring as disclosed herein.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
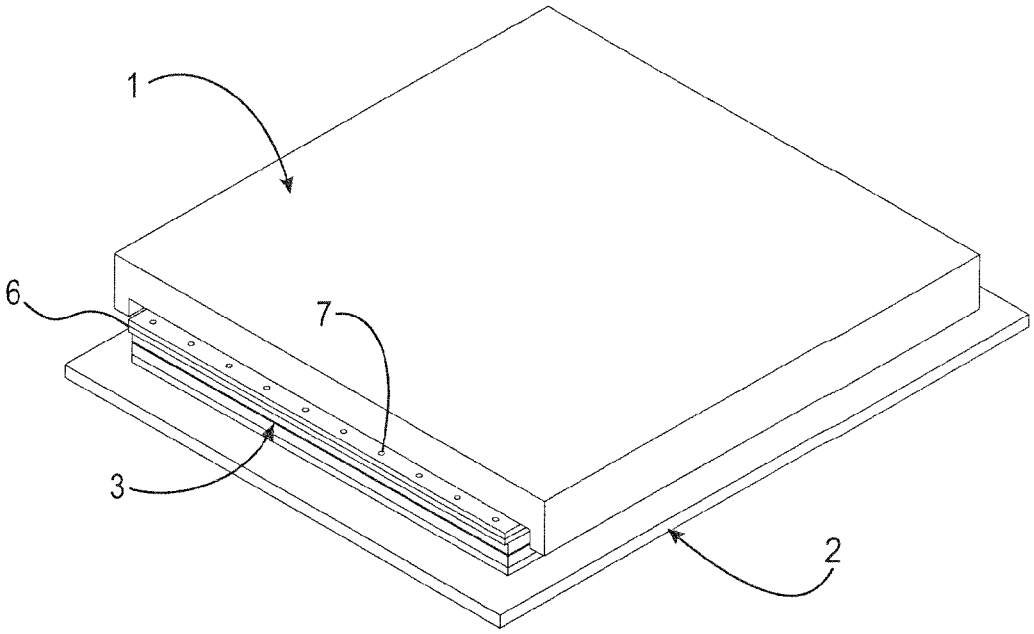
FIG. 1 is a schematic diagram showing an example embodiment of the seismic isolation bearing.

FIG. 1 is a schematic diagram showing an example embodiment of the seismic isolation bearing. The example embodiment includes a central sliding bearing core and shear springs positioned between a box housing (including an upper base plate) 1 and a lower (bottom) base plate 2. Typically the top of the box housing or base plate 1 is connected to a superstructure (the portion of a structure to be isolated), and the lower base plate 2 is connected to a substructure (e.g., foundation). Connections to the structure is not shown in the figures as the isolation bearing can be connected using standard methods. The shear spring(s) 3 provide a restoring force to the isolation bearing and, in some embodiments, may support a part of the vertical load. The shear spring(s) 3 may be connected to the box housing 1 using recessed bolt holes 7 that have been drilled through box connection plate(s) 6 and bolts. The box connection plate 6 may be affixed, by welding for example, to the box housing 1. The bottom of the shear spring(s) 3 may be connected to the lower base plate 2 either by welding, for example, or bolt-through the bottom of the lower base plate 2. Thus, the top and bottom of the shear spring(s) 3 can be firmly fixed to the box housing 1 and lower base plate 2, respectively.

Figure 2:
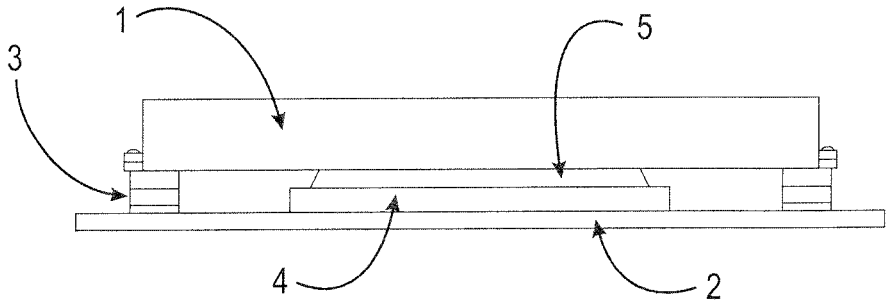
FIG. 2 is a schematic diagram showing an external front elevation of the example embodiment of the seismic isolation bearing of FIG. 1.

FIG. 2 is a schematic diagram showing an external front elevation of the example embodiment of the seismic isolation bearing of FIG. 1. The shear spring(s) 3 are shown as being positioned between the box housing 1 and lower base plate 2. The disc bearing's lower bearing plate 4 and disc 5 is visible in FIG. 2. The lower bearing plate 4 may be attached to the lower base plate 2 using various bearing attachment methods, such as welding or recessing. The elastomeric disc 5 may be centered on the lower bearing plate 4, and may be held in place by a centrally located shear pin (not shown).

Figure 3:
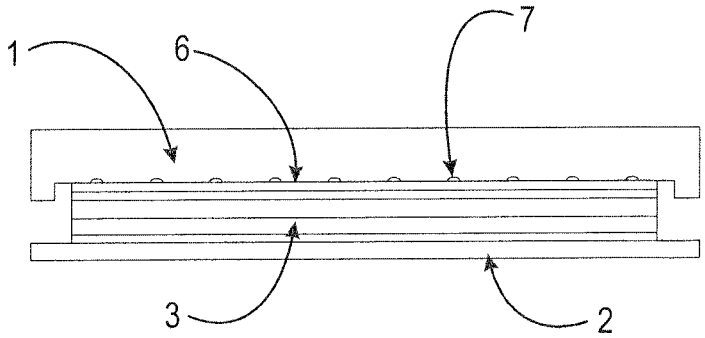
FIG. 3 is a schematic diagram showing an external side elevation of an example embodiment of the seismic isolation bearing of FIG. 1.

FIG. 3 is a schematic diagram showing an external side elevation of an example embodiment of the seismic isolation bearing of FIG. 1. The shear spring(s) 3 are shown as being coupled to the box connection plate 6 with connection bolts 7. Connection plate 6 may be rigidly attached to the box housing 1.

Figure 4:
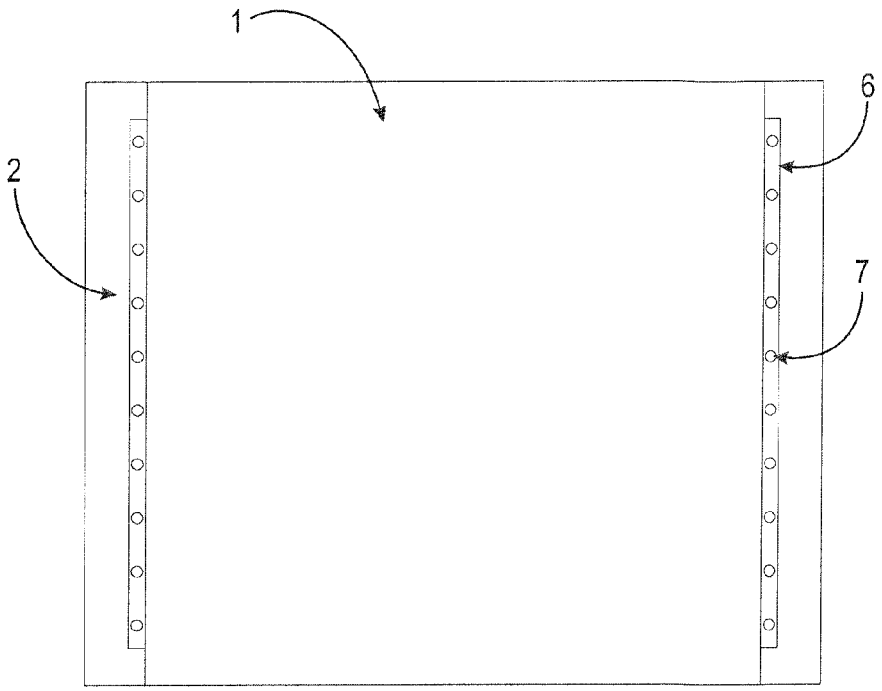
FIG. 4 is a schematic diagram showing a plan view of an example embodiment of the seismic isolation bearing of FIG. 1.

FIG. 4 is a schematic diagram showing a plan view of an example embodiment of the seismic isolation bearing of FIG. 1. FIG. 4 shows the elements of FIGS. 1-4 from a top-view.

Figure 5:
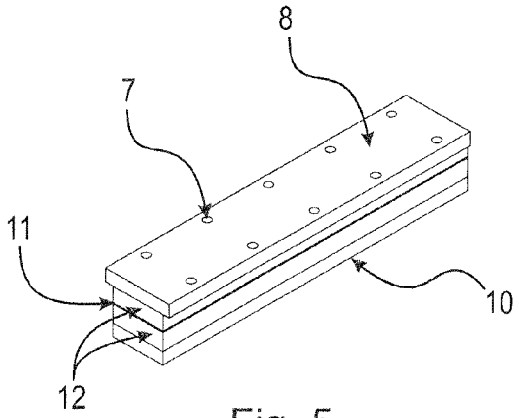
FIG. 5 is a schematic diagram showing an example embodiment of a shear spring that may be used in the seismic isolation bearing.

FIG. 5 is a schematic diagram showing an example embodiment of a shear spring that may be used in the seismic isolation bearing. FIG. 5 shows example components comprising the shear spring 3. The example shear spring 3 includes intermittent layers of an elastomer 12 that are bonded to at least one substrate layer 11. Suitable material for the elastomer layers 12 may be natural or synthetic rubbers, examples of which are, but not limited to, isoprene, silicone, neoprene, and polyurethane. The materials for the elastomeric layers 12 may vary from layer to layer. The function of the substrate 11 is to limit expansion at the interface to the elastomer layers 12, and thus material for the substrate 11 should be stiffer than the elastomer 11. In one example embodiment, the substrate material 12 may be made of steel, but alternate configurations could include other metals, as well as other stiff materials, such as composites, plastics, or even another elastomer that is stiffer than the elastomer layers 12. Rigid or semi-rigid substrate layers 11 encourage the elastomeric layers 12 to deform in shear rather than in tension; a more efficient use of the elastomer 12. An upper mounting plate 8 and lower mounting plate 10 may act as a connection to the box housing 1 and lower base plate 2, respectively.

The shear springs disclosed herein differ in a number of ways from standard steel reinforced elastomeric bearings (SREBs). Standard SREBs are used to support high vertical loads; thus, standard SREBs cannot be used to design the shear springs of the embodiments of the present invention. The present shear springs have an unusually-high aspect ratio (high rubber layer thickness) and type of elastomer. A high rubber thickness reduces the shape factor of the shear spring, which is the ratio of the loaded area (plan area) to the bulging area (elevation area) of the shear springs. In general, a high shape factor causes the rubber layer to be stiff in compression, which can be approximated by the equation $E_C=E\cdot(1+a\cdot S^2)$, where $E_C$ is the compressive modulus of a single rubber layer, E a material constant, a is a constant related to both material and geometry, and S is the shape factor. The shape factor S may be represented by the equation S=B/4T, where B is the plan dimension and T is the thickness. The concept of a reduced vertical load on the present shear springs allows $E_C$ to be small, and it follows that S may be small as well, which allows the shear springs' layer thickness to be high. With such shear springs, even moderate displacements across the thick layers can cause the shear springs elastomer and shim (substrate) layers to rotate, bend, or yield. In a reinforced elastomeric bearing setting, this could lead to catastrophic failure, as the bearing could buckle in such a position. The embodiments of the present invention, however, use a centrally-located sliding bearing, which prevents such failure. Thus, the isolation bearing disclosed herein can use shear springs with a high elastomer thickness (reduced shape factor). Thus, the present shear springs are unencumbered by a vertical load support requirement and can, thus, be designed using unique materials and methods, performing in ways not possible with standard SREBs.

Figure 6:
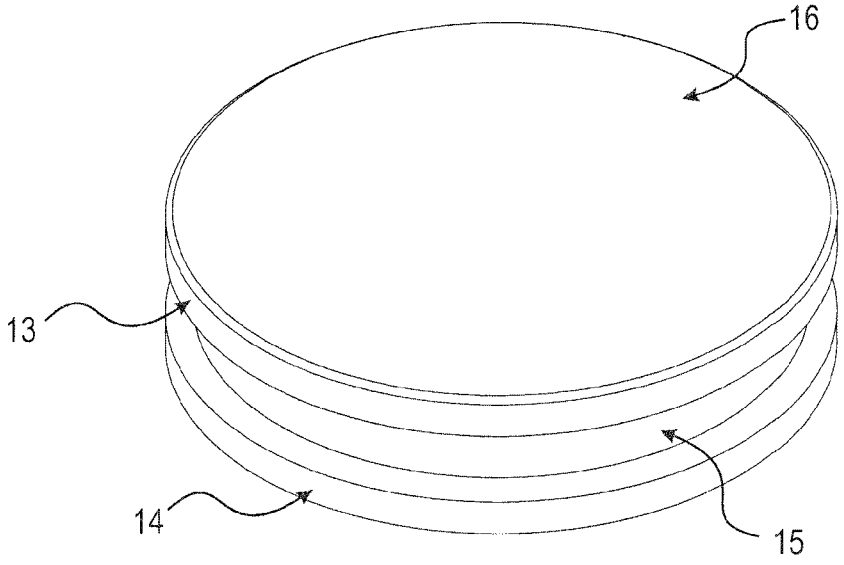
FIG. 6 is a schematic diagram showing an example embodiment of a disc bearing core used in the seismic isolation bearing.

FIG. 6 is a schematic diagram showing an example embodiment of a disc bearing core used in the seismic isolation bearing. The sliding bearing core may consist of an elastomeric disc 15 sandwiched between a upper bearing plate 13 and a lower bearing plate 14. An optional internal shear pin 17 (FIG. 8) may prevent shear deformation of the sliding bearing core. Attached to the upper bearing plate 13 may be an upper sliding rider 16. The upper sliding rider slides against an interior surface 18 of the box housing 1 (FIG. 9). The sliding rider 16 may be composed of any number of friction rider materials. Suitable materials that that may be used for the sliding rider 16 are, for example, PTFE (polytetrafluoroethylene), woven PTFE, bronze, fiber composites, and plastics, such as nylon and ultra-high molecular weight polyethylene (UHMW).

Figure 7:
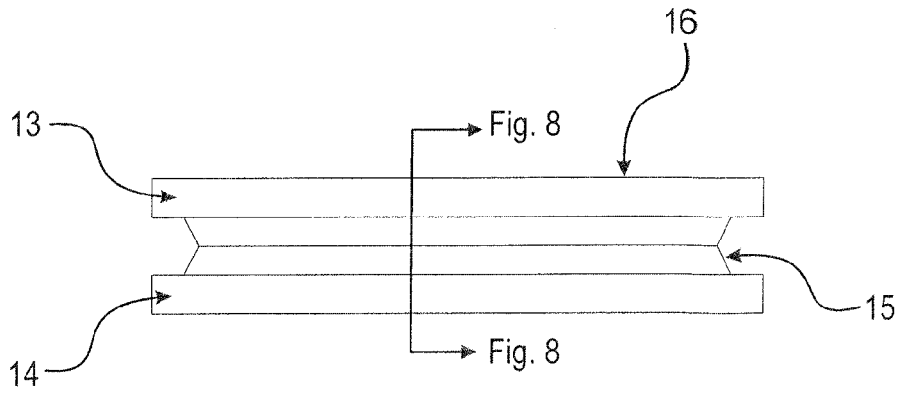
FIG. 7 is a schematic diagram showing an elevation of the disc bearing core of FIG. 6.

FIG. 7 is a schematic diagram showing an elevation of the disc bearing core of FIG. 6. The elastomeric disc 15, upper bearing plate 13, lower bearing plate 14, and sliding rider 16 are visible.

Figure 8:
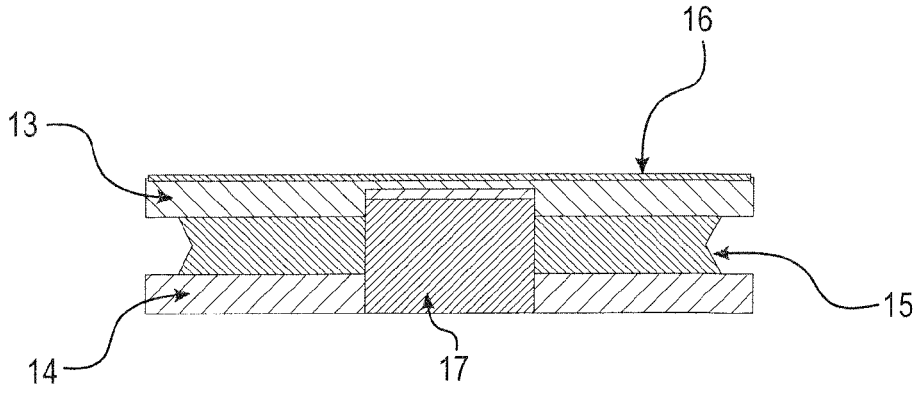
FIG. 8 is a schematic diagram showing a section view of the disc bearing core of FIG. 6.
Figure 9:
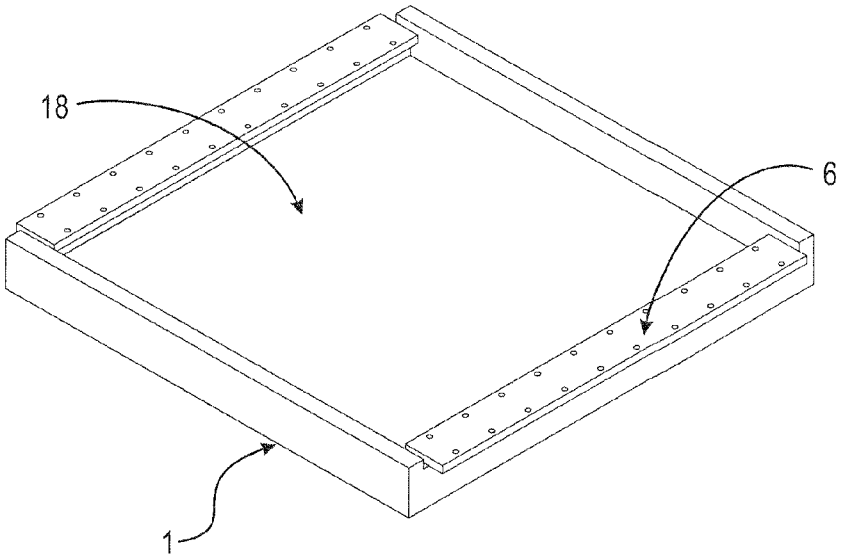
FIG. 9 is a schematic diagram showing an internal view of the seismic isolation bearing of FIG. 1 showing an example guide box configuration of the upper base plate portion of the seismic isolation bearing.

FIG. 8 is a schematic diagram showing a section view of the disc bearing core of FIG. 6 taken across line A-A. The elastomeric disc 15, upper bearing plate 13, lower bearing plate 14, sliding rider 16, and shear pin 17 are visible.

FIG. 9 is a schematic diagram showing an internal view of the seismic isolation bearing of FIG. 1 showing an example guide box configuration of the upper base plate portion of the seismic isolation bearing. The lower surface 18 of the guide box 1 and two connection plates 6 are visible.

Figure 10:
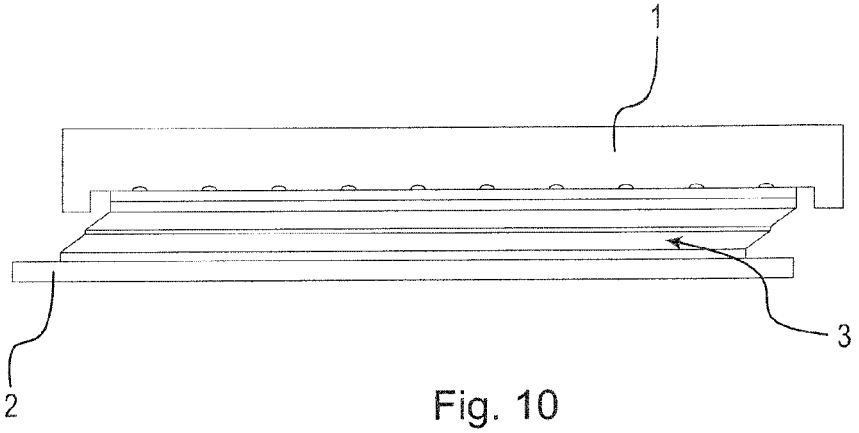
FIG. 10 is a schematic diagram showing an elevation of the seismic isolation bearing of FIG. 1 in a displaced position.

FIG. 10 is a schematic diagram showing an elevation of the seismic isolation bearing of FIG. 1 in a displaced position. The isolation bearing is displaced in the longitudinal direction ('x' units). The restoring force cause by the displacement is equal to the force across the displaced shear spring(s), $F_R=k\cdot x$, where k is the total shear spring effective spring rate for the isolation bearing. While moving with velocity v the dissipative force is $F_D=\mu\cdot W+F_{RBS}$, where μ is the sliding coefficient of friction, W is the vertical load on the isolation bearing, and $F_{RBS}$ is the total damping force of the shear spring(s). The total force across the isolation bearing is the sum of the restoring force and damping components, $F=F_R+F_D$.

Figure 11:
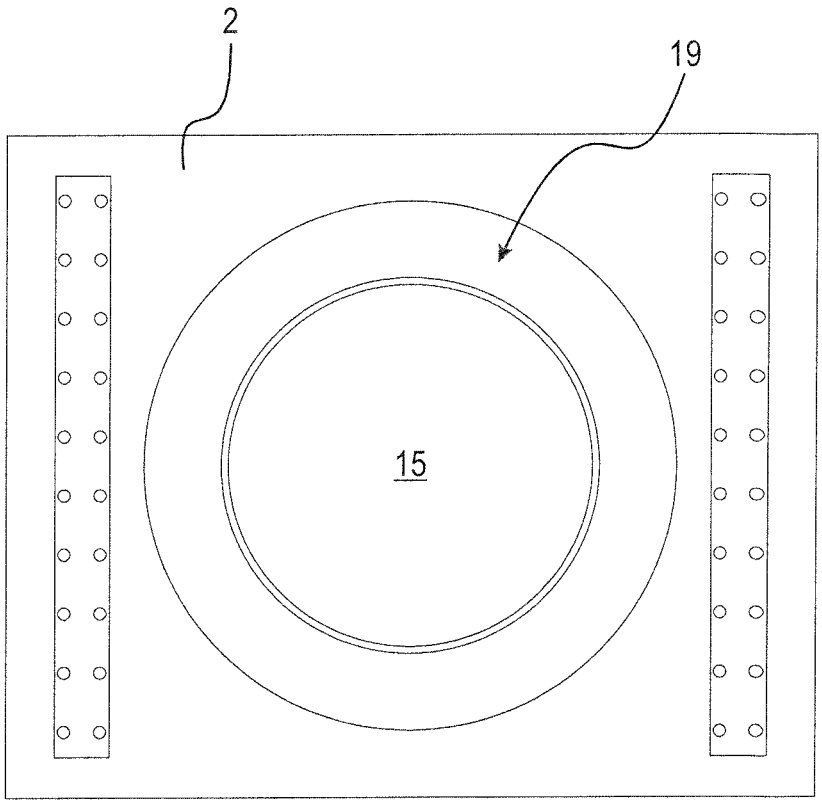
FIG. 11 is a schematic diagram showing a plan view of an example embodiment of the seismic isolation bearing with the upper base plate removed for clarity.

FIG. 11 is a schematic diagram showing a plan view of an example embodiment of the seismic isolation bearing with the upper base plate (guide box) removed for clarity. Recess 19 is a sliding surface recess that permits the bearing core 15 to slide within the confines of the recess 19. The recess 19 can be machined into the lower base plate 2, or may be formed from attachments to the lower base plate 2. The recess 19 may be flat, or may be contoured in order to help keep the bearing core centered.

Figure 12:
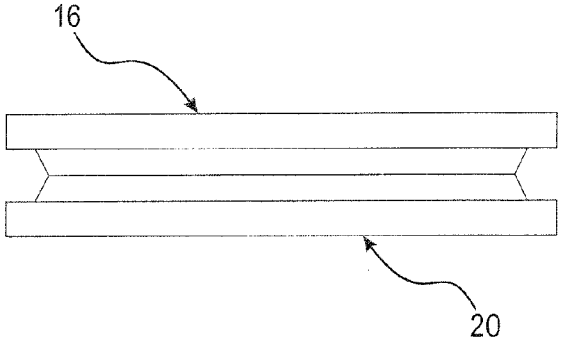
FIG. 12 is a schematic diagram showing an elevation of an example embodiment of a disc bearing core used in the embodiment of FIG. 11.

FIG. 12 is a schematic diagram showing an elevation of an example embodiment of a disc bearing core used in the embodiment of FIG. 11. The bearing core includes an upper sliding rider 16 and a lower sliding rider 20 to allow the bearing core to slide within recess 19.

Figure 13:
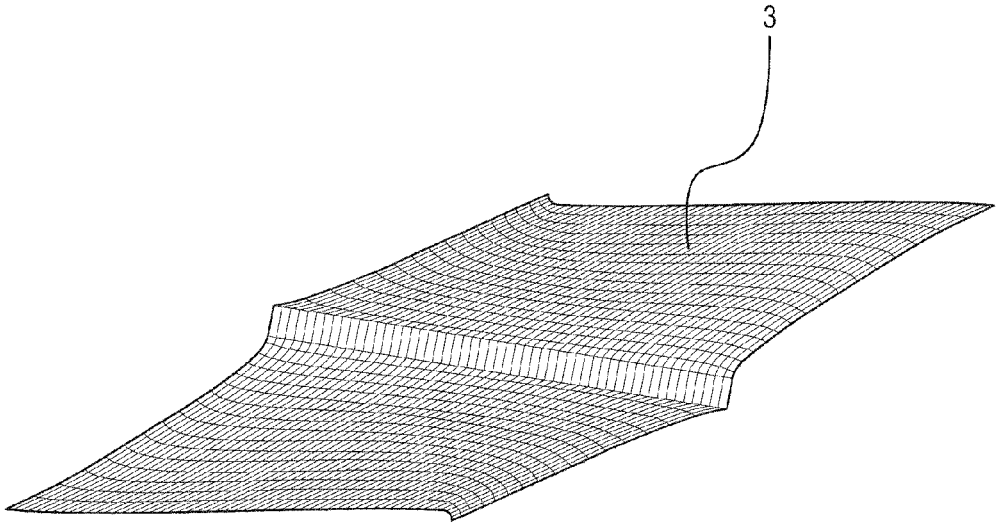
FIG. 13 is a cross-section of an example shear spring showing tilting of the substrate material upon deformation.

FIG. 13 is a cross-section of an example shear spring showing tilting of the substrate material upon deformation. Rotation of shear spring internal shims (substrate layers) can cause tensile stresses in the elastomeric layers, a stress mode known to cause sudden failure. This also has the effect of reducing the restoring force spring rate. Finite element analysis can be used check these two effects. FIG. 13, for example, shows the rotation that may occur when a shear spring is displaced in the short direction. Upon displacement, a bending moment exists on the internal shims. If the shims are made thin, or of a soft material (e.g. copper, bronze, mild steel, lead), they can yield and, in effect, can act as internal dampers. Isolation bearing damping can also be enhanced by incorporating nontraditional rubber type materials, for example, rubber foams and viscous materials.

Figure 14:
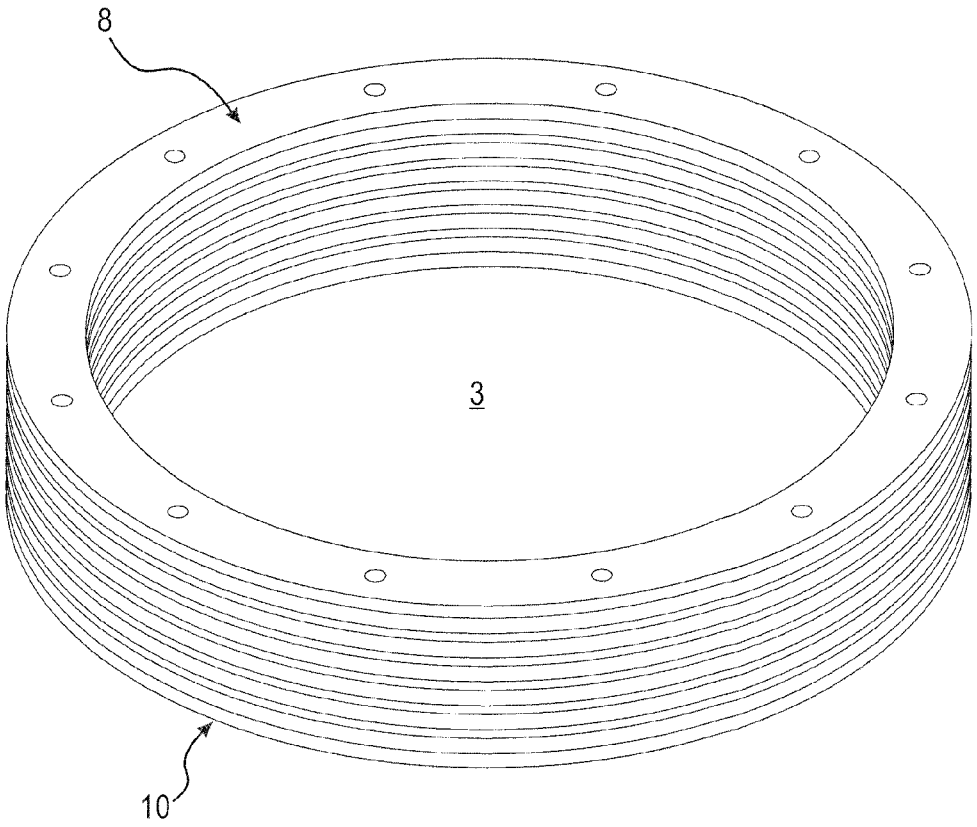
FIG. 14 is a schematic diagram showing an example embodiment of a shear spring that may be used in the seismic isolation bearing.
Figure 15:
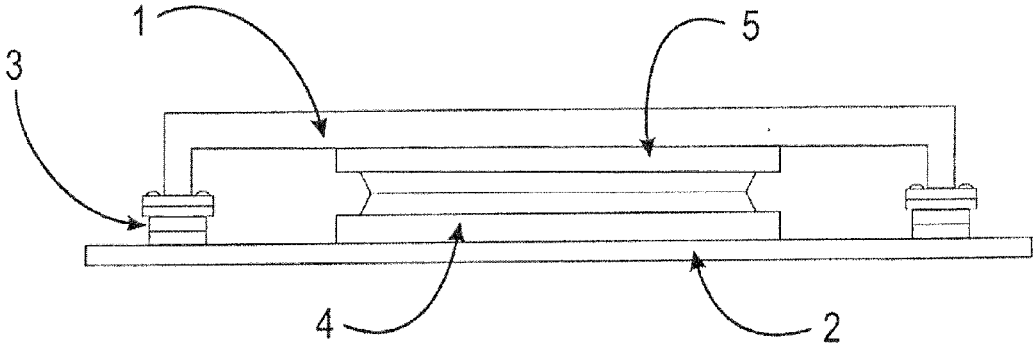
FIG. 15 is a schematic diagram showing an external side elevation of an example embodiment of the seismic isolation bearing.

FIG. 14 is a schematic diagram showing an example embodiment of a shear spring that may be used in the seismic isolation bearing. The shear spring has a circular shape that surrounds the disc bearing core of the isolation bearing. In similar embodiments, the shear spring may have an arc shape that partially surrounds the disc bearing core.

While this invention has been particularly shown and described with references to example embodiments thereof, it will be understood by those skilled in the art that various changes in form and details may be made therein without departing from the scope of the invention encompassed by the appended claims.

What is claimed is:

1. A seismic isolation bearing comprising:

an upper base plate having an upper surface and a lower surface;

a lower base plate having an upper surface and a lower surface;

a disc bearing core centrally positioned with respect to planes of the upper and lower base plates, the disc bearing core being in contact with the lower surface of the upper base plate and the upper surface of the lower base plate, and configured to allow the lower surface of the upper base plate to slide along the disc bearing core; and at least one shear spring coupled to the lower surface of the upper base plate and the upper surface of the lower base plate, the at least one shear spring (i) being configured to deform in shear upon lateral movement of the upper base plate relative to the lower base plate, and configured to exert a lateral return force on the upper base plate when the upper base plate is laterally displaced, and (ii) including alternating layers of an elastomeric material and a substrate material, the shear spring being configured to deform in shear along the layers of elastomeric material, and each layer of elastomeric material having an elevation area that is greater than its plan area.

2. A seismic isolation bearing as in claim 1 wherein a shape factor of each layer of elastomeric material does not exceed a value of 1.

3. A seismic isolation bearing as in claim 1 wherein a height of each layer of substrate material is smaller than the height of each layer of elastomeric material to provide added damping.

4. A seismic isolation bearing as in claim 1 wherein the elastomeric material is rubber and the substrate material is steel.

5. A seismic isolation bearing as in claim 1 wherein the layers of substrate material are configured to yield upon lateral deflection of the at least one shear spring to provide added damping.

6. A seismic isolation bearing as in claim 1 wherein the layers of elastomeric material are formed of a first elastomeric material and the layers of substrate material are made of a second elastomeric material, and wherein the second elastomeric material is stiffer than the first elastomeric material.

7. A seismic isolation bearing as in claim 1 wherein the at least one shear spring includes an upper mounting plate configured to attached to the lower surface of the upper base plate, and includes a lower mounting plate configured to attached to the upper surface of the lower base plate.

8. A seismic isolation bearing as in claim 1 wherein the disc bearing core is configured to support all of a load on the seismic isolation bearing, and the at least one shear spring is configured to not support any of the load on the seismic isolation bearing.

9. A seismic isolation bearing as in claim 1 wherein the at least one shear spring is configured to support less than one third of a total load on the seismic isolation bearing.

10. A seismic isolation bearing as in claim 1 wherein the upper base plate and the lower base plate are rectangular-shaped, and wherein the at least one shear spring includes four shear springs positioned along the edges of the upper and lower base plates.

11. A seismic isolation bearing as in claim 10 wherein two of the four shear springs are positioned along one edge of the upper and lower base plates, and the other two shear springs are positioned along the opposite edge of the upper and lower base plates.

12. A seismic isolation bearing as in claim 1 wherein the at least one shear spring has a circular shape that surrounds the disc bearing core.

13. A seismic isolation bearing as in claim 1 wherein the disc bearing core includes:

an upper disc bearing plate;

a lower disc bearing plate; and an elastomeric disc pad coupled between the upper disc bearing plate and the lower disc bearing plate.

14. A seismic isolation bearing as in claim 1 wherein the disc bearing core is fixed to the upper surface of the lower base plate.

15. A seismic isolation bearing as in claim 1 wherein the disc bearing core sits in a recess formed in the upper surface of the lower base plate.

16. A seismic isolation bearing as in claim 15 wherein the recess in the upper surface of the lower base plate is concaved to cause the disc bearing core to maintain a centralized position in the absence of an external lateral force.

17. A seismic isolation bearing as in claim 1 wherein the disc bearing core is configured to slide along the upper surface of the lower base plate.

18. A seismic isolation bearing as in claim 1 wherein the disc bearing core includes a shear pin at the center of the disc bearing core to prevent shearing of the disc bearing core.

19. A seismic isolation bearing as in claim 1 wherein the disc bearing core does not include a shear pin.

20. A seismic isolation bearing comprising:

an upper base plate having an upper surface and a lower surface;

a lower base plate having an upper surface and a lower surface;

a disc bearing core centrally positioned with respect to planes of the upper and lower base plates, the disc bearing core being in contact with the lower surface of the upper base plate and the upper surface of the lower base plate, and configured to allow the lower surface of the upper base plate to slide along the disc bearing core; and at least one shear spring coupled to the lower surface of the upper base plate and the upper surface of the lower base plate, the at least one shear spring being configured to deform in shear upon lateral movement of the upper base plate relative to the lower base plate, and configured to exert a lateral return force on the upper base plate when the upper base plate is laterally displaced;

the upper base plate includes edges extending toward the lower base plate to provide a partial enclosure for the disc bearing core and the at least one shear spring, and the at least one shear spring being coupled to the lower surface of the upper base plate via the edges extending toward the lower base plate.

* * * * *